US005521604A

United States Patent [19]

Yamashita

[11] Patent Number: 5,521,604

[45] Date of Patent: May 28, 1996

[54] TRACKING SYSTEM FOR VEHICLE-MOUNTED ANTENNA

[75] Inventor: Toshiaki Yamashita, Tokyo, Japan

[73] Assignee: NEC Corporation, Tokyo, Japan

[21] Appl. No.: 377,246

[22] Filed: Jan. 24, 1995

[30] Foreign Application Priority Data

Jan. 24, 1994 [JP] Japan ..... 6-005682

[51] Int. Cl.[6] ..... H01Q 3/00

[52] U.S. Cl. ..... 342/359

[58] Field of Search ..... 342/359, 77; 343/757

[56] References Cited

U.S. PATENT DOCUMENTS 5,241,319 8/1993 Shimizu ..... 342/358

*Primary Examiner*—Gregory C. Issing

*Attorney, Agent, or Firm*—Sughrue, Mion, Zinn, Macpeak & Seas

[57] ABSTRACT

In a vehicle-mounted antenna tracking system, a bearing error between the bearing angle of the antenna and the direction of arrival of a signal from a satellite, the bearing angle of the antenna, and a vehicle attitude is detected and summed together to produce a satellite position signal. The vehicle attitude and the antenna's bearing angle are summed together to produce an absolute antenna bearing signal. If the antenna is in line of sight to the satellite, the satellite position signal is stored into a memory and the bearing error signal is applied through a filter circuit to an antenna drive system so that the antenna's bearing is controlled to reduce the bearing error to a minimum. If the antenna is not in line of sight to the satellite, the stored signal is read out of the memory and a pseudo-error signal is produced by taking the difference between the signal from the memory and the absolute antenna bearing signal, and applied through the filter circuit to the antenna drive. The filter circuit comprises an autoregressive filter and an integrator whose outputs are combined in an adder.

6 Claims, 3 Drawing Sheets

AR FILTER 24

$$\text{Transfer function} = \frac{b_0 s^2 + a_1 s + a_2}{s^2 + b_1 s + b_2}$$

where, $a_1 = 149{,}8065$
$a_2 = 1 \times 10^4$
$b_0 = 1$
$b_1 = 0$
$b_2 = 77{,}3777$

TRACKING SYSTEM FOR VEHICLE-MOUNTED ANTENNA

BACKGROUND OF THE INVENTION

1. Field of the Invention

The present invention relates generally to antenna tracking systems, and more specifically to a satellite mobile communications system wherein a vehicle-mounted antenna is controlled to orient its bearing toward the satellite.

2. Description of the Related Art

In a conventional tracking system for a vehicle-mounted antenna, the orientation of the antenna is controlled in response to the difference between the antenna's bearing angle and the angle of arrival of a signal from the satellite so that the difference reduces to a minimum. This feedback operation continues as long as the antenna is in line of sight to the satellite. If the line-of-site to the satellite is obstructed by a land structure, the system enters an open-loop mode in which the vehicle's attitude is detected and used to control the antenna's bearing angle.

However, there is a no smooth transition as the system operation changes from the closed loop to open loop mode and then returns to the closed mode.

In addition, due to the vehicle's movements the bearing angle of the antenna cannot be precisely maintained within a desired range. Currently, the antenna's bearing angle has a tolerance of ±10° to ±15°.

SUMMARY OF THE INVENTION

It is therefore an object of the present invention to provide a tracking system and method for a vehicle-mounted antenna that ensures smooth transition when the system changes between closed and open loop modes.

Another object of the present invention is to eliminate the effect of the vehicle's movements on the antenna's bearing.

According to the present invention, there is provided a vehicle-mounted tracking system which comprises an antenna drive for controlling the bearing of an antenna, and a bearing error sensor for detecting a bearing error between the bearing angle of the antenna and the direction of arrival of a signal from a radio transmission source, such as a communications satellite, to produce a bearing error signal. An antenna bearing sensor is provided for detecting the bearing angle of the antenna to produce an antenna bearing signal. A vehicle attitude sensor produces a vehicle attitude signal representing the attitude of the vehicle. The bearing error signal, the antenna bearing signal and the vehicle attitude signal are summed together to produce a source (satellite) position signal, and the antenna bearing signal and the vehicle attitude signal are summed together to produce an absolute antenna bearing signal. A detector is provided for determining whether or not the antenna is in line of sight to the source. If the antenna is in line of sight to the source, the source position signal is stored into a source position memory and if the antenna is not in line of sight to the source the stored signal is read out of the memory. A pseudo-error signal is produced by taking the difference between the signal from the memory and the absolute antenna bearing signal. A filter circuit is connected to the antenna drive. When the antenna is in line of sight to the transmission source, the bearing error signal is applied to the filter circuit and when the transmission source is out of sight, the pseudo-error signal is applied to the filter circuit.

The filter circuit comprises an autoregressive filter, an integrator and an adder. The filter has a transfer function of second order that approximates rapid oscillatory movements of the vehicle by modeling on an autoregressive process. The integrator approximates slow oscillatory movements of the vehicle. The outputs of the autoregressive filter and the integrator are summed by the adder to control the antenna drive.

BRIEF DESCRIPTION OF THE DRAWINGS

The present invention will be described in further detail with reference to the accompanying drawings, in which.

DETAILED DESCRIPTION

Figure 1:
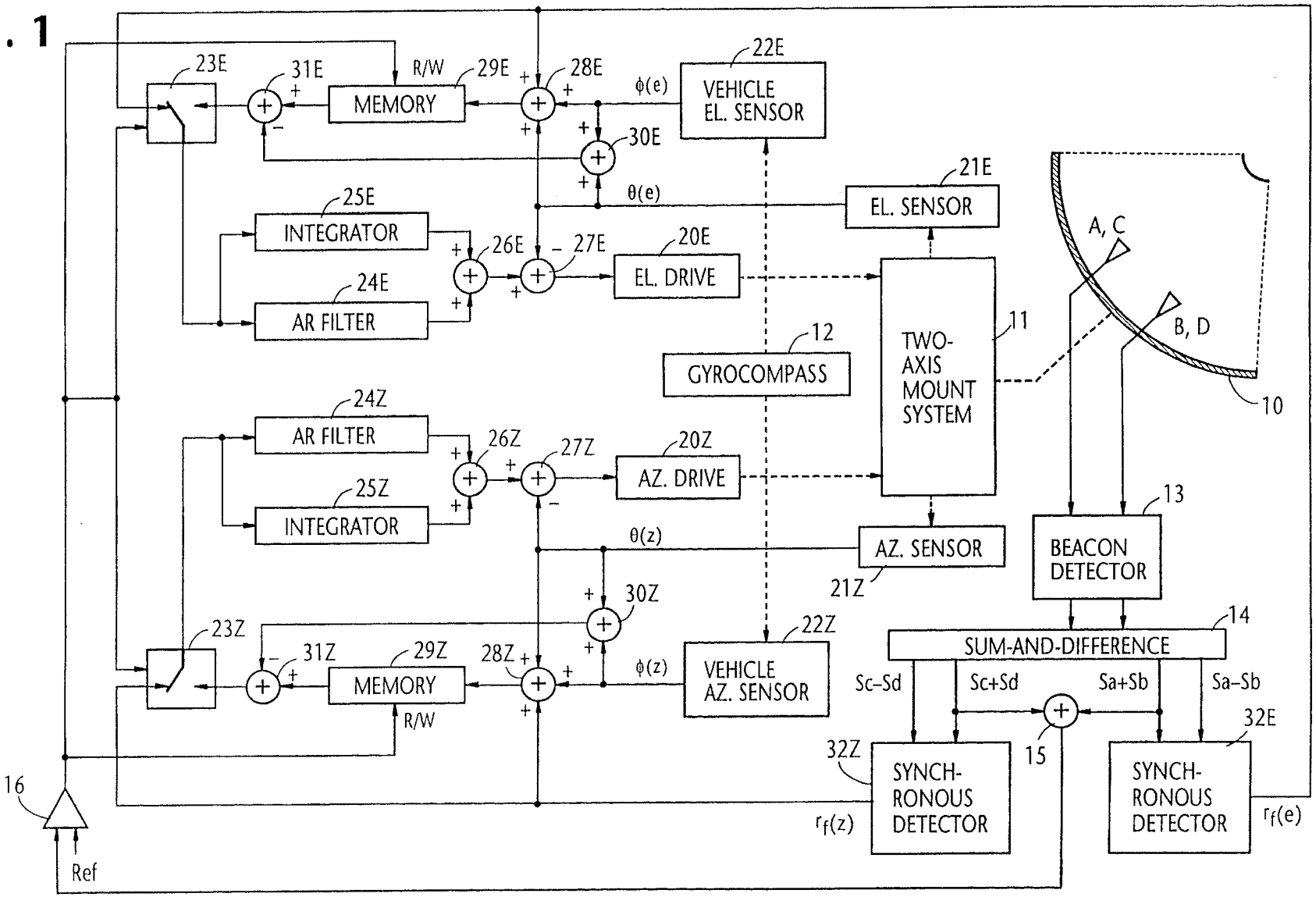
FIG. 1 is a block diagram of a vehicle-mounted satellite tracking system according to the present invention.

Referring now to FIG. 1, there is shown a tracking system for a vehicle-mounted antenna according to the present invention. The tracking system includes a multi-horn parabolic antenna 10 oriented toward a geostationary communications satellite. Antenna 10 has a first pair of horns A and B and a second pair of horns C and D on its paraboloidal surface. The antenna 10 is mounted on a two-axis mount system 11 which is driven by an elevation drive 20E and azimuth drive 20Z and to which an elevation angle sensor 21E and an azimuth angle sensor 21Z are also connected to provide signals representing the antenna's angle of elevation θ(e) and azimuth angle θ(z), respectively. A gyrocompass 12 is mounted on the vehicle to detect its attitude and a vehicle elevation sensor 22E and a vehicle azimuth sensor 22Z are connected to the gyrocompass 12 to produce signals representing the vehicle's angle of elevation ϕ(e) and azimuth angle ϕ(z).

A beacon detector 13 is connected to the horns A, B, C and D to produce beacon signals A, B, C and D from the respective horns. The detected beacon signals are fed to a sum-and-difference circuit 14 where a sum signal Sa+Sb and a difference signal Sa−Sb are taken for angle-of-elevation control and a sum signal Sc+Sd and a difference signal Sc−Sd are taken for azimuth angle control. The sum signals Sa+Sb and Sc+Sd are combined by an adder 15 and supplied to a comparator 16 where it is compared with a reference value. When the antenna 10 is in line of sight with a desired communications satellite, the output of adder 15 is higher than the reference value, and comparator 16 produces a logic-0 output which is supplied to switches 23E and 23Z for holding their contacts in the left position. The logic-0 output is also applied to satellite position memories 30E and 30Z as a write enable signal. When the line of sight to the satellite is obstructed by a land structure or terrain, the output of adder 15 reduces to a level lower than the reference value, and comparator 16 produces a logic-1 output which causes switches 23E and 23Z to move their contacts to the right position. The comparator's logic-1 output represents a read enable signal for the satellite position memories 29E and 29A. The purpose of the memories 29E and 29Z is to store a satellite absolute position about the elevation and azimuth axes when the antenna is in line of sight with the satellite and to use the stored position data for tracking control when the line-of-sight is obstructed.

The sum and difference signals Sa+Sb and Sa−Sb are supplied to a synchronous detector 32E to produce a signal $r_f(e)$ representative of the difference between the beacon's elevation angle and the antenna's angle of elevation. Likewise, the sum and difference signals Sc+Sd and Sc−Sd are supplied to a synchronous detector 32Z to produce a signal $r_f(z)$ representative of the difference between the beacon's azimuth angle and the antenna's azimuth angle.

During the line-of-sight condition, the difference signals $r_f(e)$ and $r_f(z)$ are supplied through the switches 23E and 23A to respective tracking control circuits for elevation and azimuth angles. The tracking control circuit for angle of elevation includes an autoregressive (AR) filter 24E, an integrator 25E and an adder 26E which provides a sum of the outputs of AR filter 24E and integrator 25E to produce a control signal for driving the elevation drive 20E. As will be described later, the autoregressive filter 24E serves to absorb the effect of the vehicle's rapid movements on the bearing of the antenna by modeling an autoregressive process, while the integrator 25E serves to absorb the effect of the vehicle's relatively slow movements on the antenna's orientation. The control signal provided by the adder 26E is the main control signal for operating the EL drive 20E. As an auxiliary control signal, the output signal of elevation sensor 21E is used to improve the antenna's elevation angle control by subtracting the sensed elevation angle θ(E) from the output of adder 26E in a subtractor 27E and operating the elevation drive 21E with the output of subtractor 27E.

In the same manner, the tracking control circuit for azimuth angle includes an autoregressive filter 24A, an integrator 25Z and an adder 26Z which provides a sum of the outputs of AR filer 24Z and integrator 25Z to produce a control signal for driving the azimuth drive 20Z. The control signal provided by the adder 26Z is the main control signal for operating the azimuth drive 20A. As an auxiliary control signal, the output signal of elevation sensor 21Z is used to improve the antenna's azimuth angle control by subtracting the sensed azimuth angle θ(z) from the output of adder 26Z in a subtractor 27Z and operating the azimuth drive 21Z with the output of subtractor 27Z.

An absolute elevation angle of the satellite is represented by a sum of the signals $r_f(e)$, θ(e) and ϕ(e), and produced by an adder 28E and supplied to the memory 29E and stored therein when the satellite is in line of sight to be used during an out-of-sight condition. An absolute elevation angle of the antenna 10 is represented by a sum of the signals θ(e) and ϕ(e) which is produced by an adder 30E. The output of adder 30E is applied to a subtractor 31E where it is subtracted from a signal which is read out of memory 29E to produce a pseudo-error signal.

In like manner, an absolute azimuth angle of the satellite is represented by a sum of the signals $r_f(z)$, θ(z) and ϕ(z) and produced by an adder 28Z and supplied to the memory 29Z and stored therein when the satellite is in line of sight to be used during an out-of-sight condition. An absolute azimuth angle of the antenna 10 is represented by a sum of the signals θ(z) and ϕ(z) which-is produced by an adder 30Z whose output is applied to a subtractor 31Z where it is subtracted from a signal read out of memory 29Z.

The satellite absolute positions (elevation and azimuth) stored in memories 29E and 29Z are updated with a new value whenever it occurs as long as the line of sight condition prevails.

The tracking system operates as follows. When the antenna 10 and the satellite are in line of sight, the comparator 16 produces a logic-0 signal that holds the switches 23E and 23Z in the left position so that the outputs of synchronous detectors 32E and 32Z are coupled through switches 23E, 23Z to the respective tracking control circuits and the elevation drive 20E and azimuth drive 20Z are controlled, so that the signals $r_f(e)$ and $r_f(z)$, and hence the outputs of subtractors 27E and 27Z reduce to a minimum. In this way, antenna 10 is oriented in a direction to the satellite. Memories 29E, 29Z are in a write mode to store the respective absolute satellite positions.

If the line of sight is obstructed by a land structure, the comparator 16 produces a logic-1 output, causing the switches 23E, 23Z to move to the right position and causing the memories 29E, 29Z to change to a read mode. The stored satellite position signals are read from the memories and supplied to subtractors 31E and 31Z. The antenna's absolute elevation angle position from adder 30E is subtracted from the satellite's absolute elevation angle position and fed to the AR filter 24E and integrator 25E, instead of the angle difference signal from synchronous detector 32E. Similarly, the antenna's absolute azimuth angle position from adder 30Z is subtracted from the satellite's absolute azimuth angle position and fed to the AR filter 24Z and integrator 25Z, instead of the angle difference signal from synchronous detector 32Z. Using the stored satellite position data as temporary data, the elevation drive 20E and azimuth drive 20Z are controlled to keep the antenna in a direction toward the satellite. When the satellite comes into view again, the outputs of synchronous detectors 32E, 32Z take over the stored satellite position data. Smooth transition is provided for the system as it resumes the normal feedback control.

Figure 2:
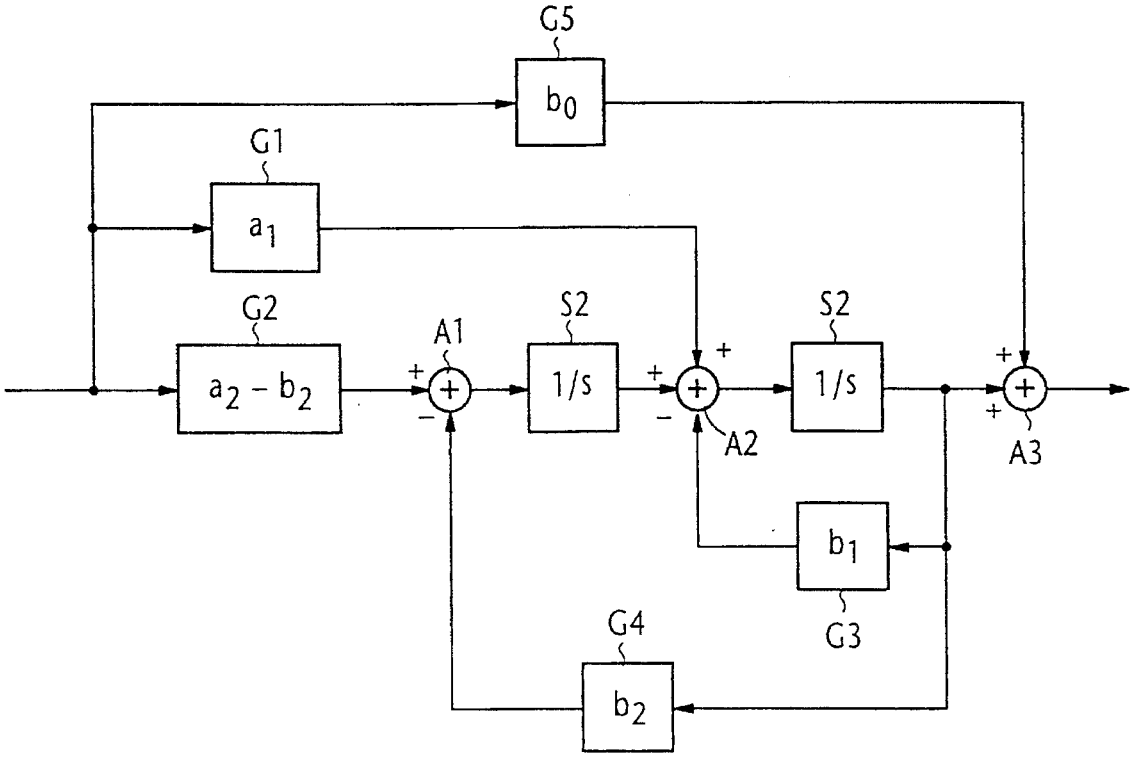
FIG. 2 is a block diagram of an autoregressive filter.

Each autoregressive filter is an autoregressive process model which is approximated by a transfer function represented by the relation $(b_0{}^{s2}+a_1s+a_2)/(s^2+b_1s+b_2)$, where s is the Laplace operator and $a_1$, $a_2b_0$, $b_1$ and $b_2$ are filter coefficients. These filter coefficients are determined using the Burg's lattice-based method so that each filter has a frequency of 1.4 Hz and an amplitude of ±1° corresponding to the vibration characteristics of the vehicle. For further information see "Digital Spectral Analysis with applications", S. L. Marple, Jr., Prentice-Hall, Englewood Cliffs, 1987, Chapter 8. As illustrated in FIG. 2, the AR filters are implemented with amplifiers G1, G2, G3, G4 and G5, integrators S1 and S2, and adders A1, A2 and A3. The input terminal of each AR filter 24 is connected to amplifiers G1, G2 and G5. Amplifier G1 has a gain $a_1$ and feeds its output to the positive input of adder A2, and amplifier G2 has a gain "$a_2$−$b_2$" and feeds its output to the positive input of adder A1. Amplifier G5 has a gain $b_0$ and its output is coupled to an adder A3. The output of adder A1 is integrated by integrator S1 and fed to a positive input of adder A2. The output of second adder A2 is integrated by integrator S2 and supplied to adder A3 where it is summed with the output of amplifier G5. The output of integrator S2 is fed back through amplifier G3 with a gain $b_1$ to the negative input of adder A2 and through amplifier G4 with a gain $b_2$ to the negative input of adder A1. The filter is implemented with the following filter coefficients:

$a_1$=149,8065

$a_2$=1×10$^4$ $b_0$=1

$b_1$=0

$b_2$=77,3777

Figure 3:
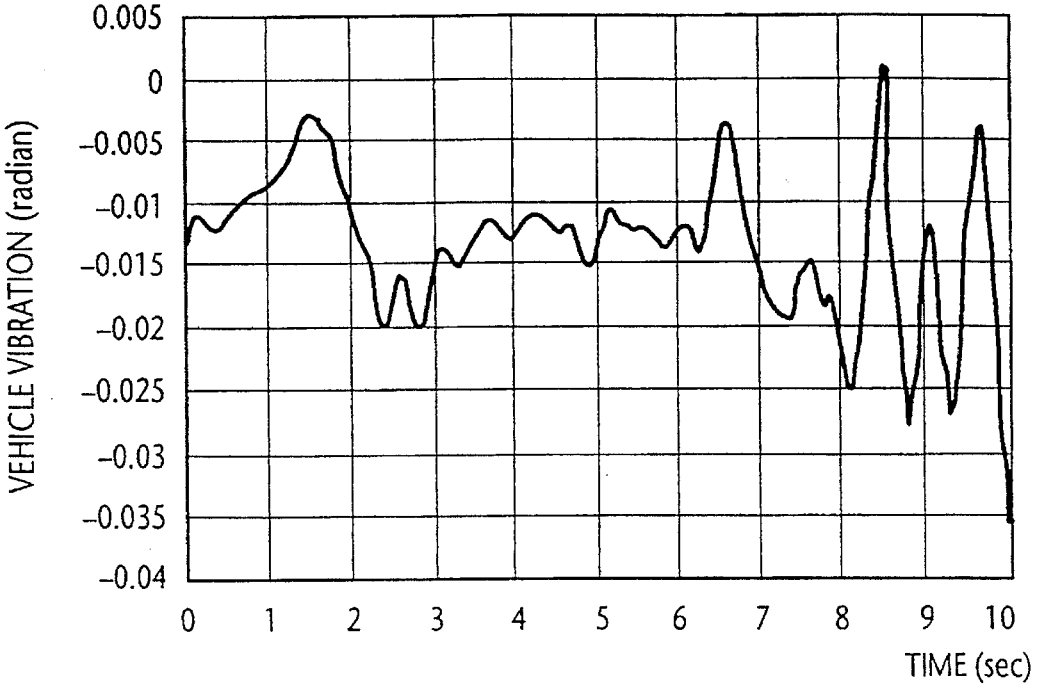
FIG. 3 is a graphic representation of the vibration of a motor vehicle.
Figure 4:
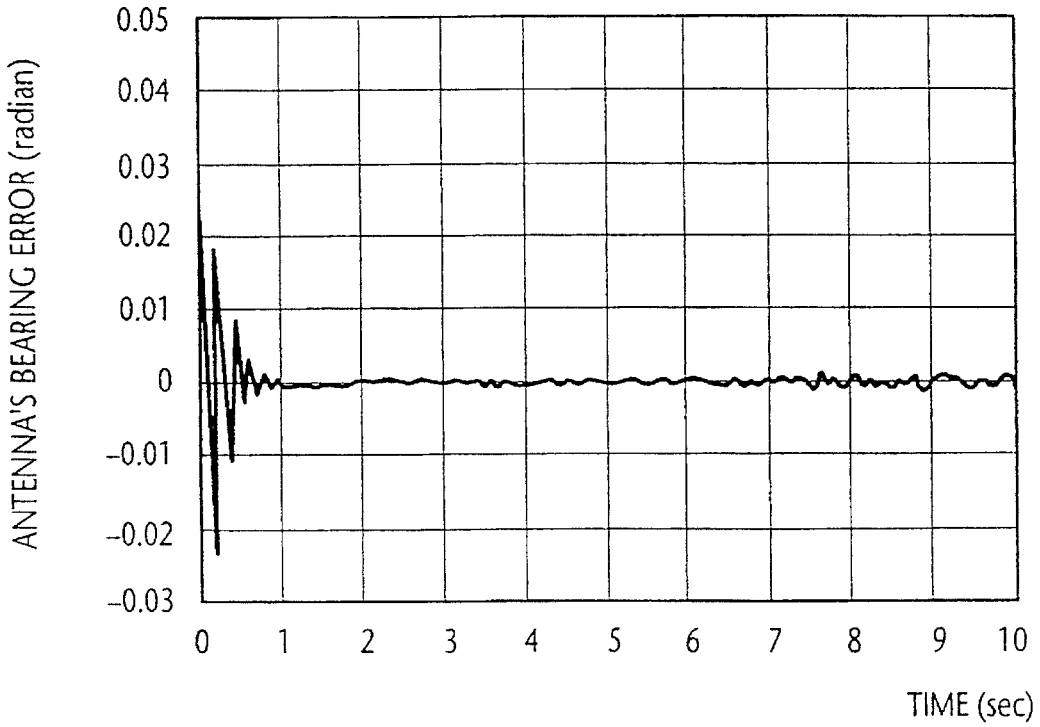
FIG. 4 is a graphic representation of the bearing error of the antenna of the present invention using the vehicle vibration as an input of the AR filters.

Since gain $b_1$ is zero, amplifier G3 can be dispensed with. To verify the operation of the AR filters, vibration data was obtained from an automotive vehicle as shown in FIG. 3 and used it as an input of the AR filters. As indicated in FIG. 4, the antenna's bearing error is kept within a range of ±0.1° (corresponding to ±0.0017 radian).

What is claimed is:

1. A vehicle-mounted tracking system comprising:

antenna drive means for controlling the bearing of an antenna;

a bearing error sensor for detecting a bearing error between the bearing angle of said antenna and the direction of arrival of a signal from a radio transmission source and producing a bearing error signal;

an antenna bearing sensor for detecting a bearing angle of said antenna and producing an antenna bearing signal;

a vehicle attitude sensor for detecting an attitude of the vehicle and producing a vehicle attitude signal;

means for summing said bearing error signal, said antenna bearing signal and said vehicle attitude signal to produce a source position signal, and summing said antenna bearing signal and said vehicle attitude signal to produce an absolute antenna bearing signal;

a memory;

means for determining whether or not said antenna is in line of sight to said source, causing the source position signal to be stored into said memory if said antenna is in line of sight to said source, and causing the stored signal to be read from the memory if said antenna is not in line of sight to said source;

means for detecting a difference between the signal from the memory and said absolute antenna bearing signal to produce a pseudo-error signal;

filter means-connected to said antenna drive means; and switch means for applying said bearing error signal to said filter means if said antenna is determined to be in line of sight to said source and applying the pseudo-error signal to said filter means if said antenna is determined to be not in line of sight to said source.

2. A vehicle-mounted tracking system as claimed in claim 1, wherein said filter means comprises an autoregressive filter having a transfer function of second order approximating rapid oscillatory movements of the vehicle, an integrator having a characteristic approximating slow oscillatory movements of the vehicle, and means for summing outputs of the autoregressive filter and the integrator.

3. A vehicle-mounted tracking system as claimed in claim 1, further comprising means for detecting a difference between an output signal of said filter means and said antenna bearing signal and controlling said antenna drive means according to the detected difference.

4. A vehicle-mounted tracking system as claimed in claim 1, wherein the source of radio transmission is a geostationary communications satellite.

5. A method for controlling a vehicle-mounted antenna, comprising the steps of:

a) detecting a bearing error between the bearing angle of said antenna and the direction of arrival of a signal from a radio transmission source and producing a bearing error signal;

b) detecting a bearing angle of said antenna and producing an antenna bearing signal;

c) detecting an attitude of the vehicle and producing a vehicle attitude signal;

d) summing said bearing error signal, said antenna bearing signal and said vehicle attitude signal to produce a source position signal, and summing said antenna bearing signal and said vehicle attitude signal to produce an absolute antenna bearing signal;

e) determining whether or not said antenna is in line of sight to said source and causing the source position signal to be stored into a memory if said antenna is in line of sight to said source, or causing the stored signal to be read from the memory if said antenna is not in line of sight to said source;

f) detecting a difference between the signal from the memory and said absolute antenna bearing signal to produce a pseudo-error signal; and g) filtering said bearing error signal and controlling the bearing of said antenna according to the filtered bearing error signal if said antenna is determined to be in line of sight to said source and filtering the pseudo-error signal and controlling the bearing of said antenna according to the filtered pseudo-error signal if said antenna is determined to be not in line of sight to said source.

6. A method as claimed in claim 3, wherein the source of radio transmission is a geostationary communications satellite.

* * * * *

UNITED STATES PATENT AND TRADEMARK OFFICE

CERTIFICATE OF CORRECTION

PATENT NO. : 5,521,604
DATED : May 28, 1996
INVENTOR(S) : Toshiaki YAMASHITA

It is certified that error appears in the above-indentified patent and that said Letters Patent is hereby corrected as shown below:

Column 4, line 34, delete "$b_o^{s2}$" and insert --$b_o s^2$--.

Signed and Sealed this

Twenty-seventh Day of August, 1996

*Attest:*

BRUCE LEHMAN

*Attesting Officer*

*Commissioner of Patents and Trademarks*